United States Patent [19]

Perkins

[11] 4,044,834

[45] Aug. 30, 1977

[54] APPARATUS AND METHOD FOR CONTROLLING THE FLOW OF FLUIDS FROM A WELL BORE

[76] Inventor: Lee E. Perkins, 127 Malibu Blvd., Houma, La. 70360

[21] Appl. No.: 566,399

[22] Filed: Apr. 9, 1975

[51] Int. Cl.[2] ..... E21B 43/12; F16K 31/122

[52] U.S. Cl. ..... 166/314; 166/53; 175/25; 175/38; 175/218; 251/63; 251/63.5; 251/126

[58] Field of Search ..... 138/43; 137/505.13, 137/528; 166/91, 64, 53; 175/25, 38, 218; 251/121, 122, 126, 62, 63, 63.5; 91/421

[56] References Cited

U.S. PATENT DOCUMENTS

| | | | |
|---|---|---|---|
| 122,427 | 1/1872 | Barnett et al. | 138/43 |
| 1,964,196 | 6/1934 | Cuttat | 91/421 |
| 2,323,115 | 6/1943 | Bryant | 138/43 |
| 3,189,045 | 6/1965 | McCloud | 137/505.13 |
| 3,362,487 | 1/1968 | Lindsey | 175/218 |
| 3,470,972 | 10/1969 | Dower | 175/25 |
| 3,476,153 | 11/1969 | Roland | 251/324 |
| 3,508,577 | 4/1970 | Vincent et al. | 137/528 |
| 3,563,508 | 2/1971 | De Lorenzo | 251/63.5 |
| 3,677,353 | 7/1972 | Baker | 175/25 |
| 3,693,732 | 9/1972 | Sabi | 175/25 |
| 3,791,621 | 2/1974 | Hayatdaroudi | 175/25 X |
| 3,827,511 | 8/1974 | Jones | 175/25 |
| 3,838,707 | 10/1974 | Wachowitz, Jr. | 251/63.5 X |

FOREIGN PATENT DOCUMENTS

| | | | |
|---|---|---|---|
| 1,213,281 | 11/1970 | United Kingdom | 175/25 |

OTHER PUBLICATIONS

"Well Kicks Automatically Controlled", World Oil, Oct., 1968, pp. 113–116.

Rehm, "How to Use the Adjustable Chokes," Oil & Gas Journal, vol. 68, No. 7, Feb. 16, 1970, pp. 85–89.

*Primary Examiner*—Stephen J. Novosad

*Attorney, Agent, or Firm*—Fleit & Jacobson

[57] ABSTRACT

There is disclosed a device and a method for controlling the flow of fluid from a well bore. The device comprises a fluid control valve placed in the choke line of a well and has a shaped helical or spiral duct formed in one embodiment by a tapered screw-like plug engaging a hollow sleeve. In another embodiment, the plug is cylindrical and screw-like threads are formed in the hollow sleeve. The valve increases the degree of control over well bore pressure and flow rate as the well bore pressure fluctuates. The valve responds automatically to changes in the well bore pressure and is controlled by a control system including a hydraulic circuit and controls which visually indicate the position of the screw-like plug with respect to the hollow sleeve. The movement of the plug is controlled by the control system and the net pressure exerted on the plug by the fluid flowing through the control valve from the well bore.

27 Claims, 10 Drawing Figures

Fig. 6
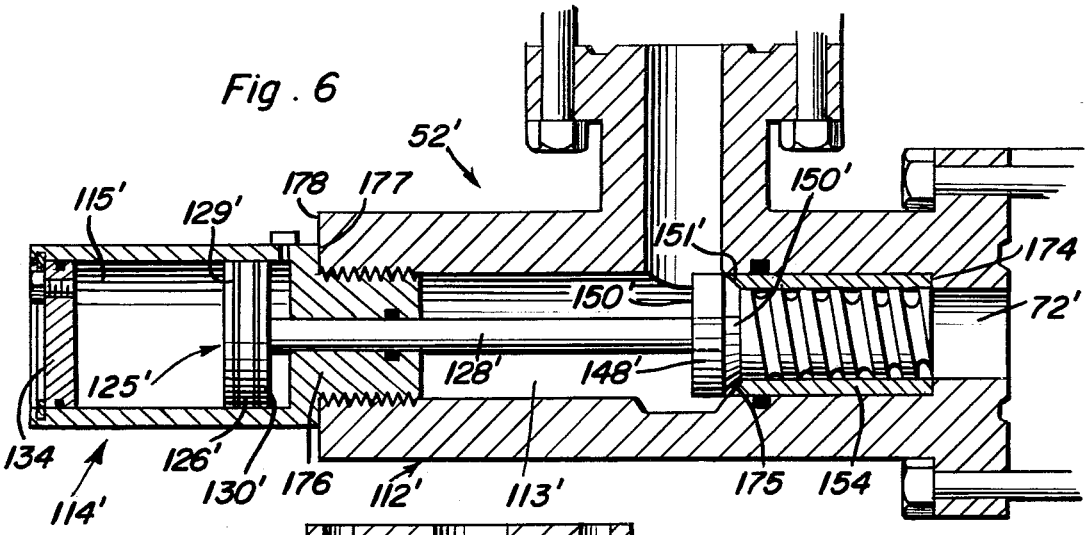
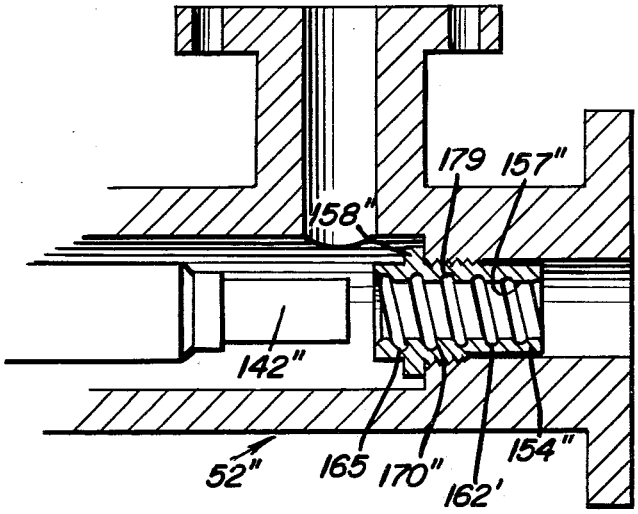
Fig. 7
Fig. 8
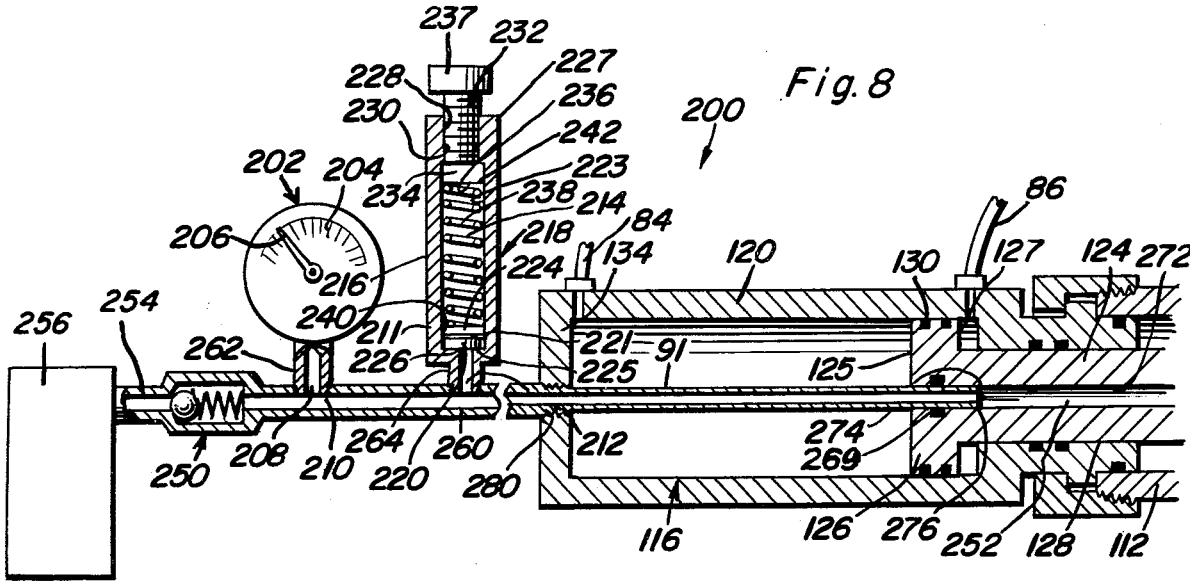

APPARATUS AND METHOD FOR CONTROLLING THE FLOW OF FLUIDS FROM A WELL BORE

BACKGROUND

The present invention relates to a control valve and system for a well bore and more particularly to an apparatus and method for automatically controlling the flow of fluid from a well bore. Specifically, the present invention relates to a new and improved fluid control valve mechanism for controlling or choking the fluid flow from well bores.

In the well drilling industry, it is a usual practice to provide a choke system for the drilling fluid conducted from the well bore to a receiving tank whereby the choke system maintains a predetermined level of pressure in the well bore and therefore controls the flow of fluid from that bore. The choke system is located outside of the well bore and is connected to a well casing beneath the well blowout prevention apparatus in a normal assemblage, such as shown in U.S. Pat. No. 3,552,502.

Known choke systems, such as the aforementioned patent, are employed to control the flow of fluid from a well bore after a kick or attempted blowout has occurred and work with the blowout prevention apparatus to establish and maintain proper back pressure in the well bore. The back pressure maintained by the choke system is combined with the hydrostatic pressure of the drilling fluid to prevent a back flow into the well bore during the kick. The back pressure applied by the choke system is held until hydrostatic fluid circulated into the bore has returned to the surface thus killing the well.

Known choking systems utilize a variety of choking devices, one of which is the positive choke. A positive choke has a predetermined size and is installed in a choke body and therefore must be physically changed as conditions change. Commonly changing conditions such as well bore pressure or drilled formation brought to the surface may plug the choke and necessitate its removal. The removed choke must then be either unplugged or replaced, thus resulting in costs added to the already high costs involved in well drilling operations.

Another known choke device utilizes a stationary disc with a half moon-like opening coacting with another similarly shaped movable disc. The movable disc is controlled by a shaft that transmits rotational movement thereto. When the openings of the two discs are in alignment, the choking device is in the fully open position and as the movable disc is rotated, the opening is altered to control the flow rate of fluid passing through the choke. The choke can be rotated from the above-described fully-open position into a fully-closed position wherein the half-moon opening of the movable disc assumes a position opposite to the opening of the stationary disc. However, this type of choke tends to erode very rapidly due to the manner with which flow is restricted.

Still other well choke, such as the one shown in U.S. Pat. No. 3,429,385, utilizes an open or cylindrical seat which is held stationary with respect to a plug-shaped body and uses a hydraulic cylinder to control the movement of the plug shaped body toward and away from the cylindrical seat. The distance between the seat and the plug-shaped body determines the degree to which the choke is opened with the choke being fully closed when the plug-shaped body is fully inserted into the seat. However, this choke, like the others, tends to erode rapidly and, also like the others, requires elaborate and expensive control systems and panels for satisfactory choke operation.

SUMMARY OF THE INVENTION

Briefly stated, the present invention overcomes the foregoing drawbacks of prior devices by providing a well choke with a tapered helical or spiral duct through which the well fluid passes. Automatic control of the duct position by a control system effects further flow and pressure control. Thus the device of the present invention controls the flow from and pressure in a well bore automatically in response to that flow and/or pressure. The choke valve means inserted in a choke line through which fluid from a well bore passes comprises a plug having, in one embodiment, an externally threaded body which has a tapering minor dimension and which slidingly engages within a replaceable cylindrical sleeve inserted into the exit duct of the choke valve to produce a tapered helical duct through which the well fluid must pass. The tapered helical duct defines the fluid communication restriction between the inlet and the outlet of the choke valve. Thus, the flow area for the valve changes according to the amount of engagement or insertion of the plug within the sleeve insert.

Movement of the plug with respect to the sleeve insert is controlled by a hydraulically operated piston means in accordance with the net force exerted by the fluid passing through the valve tending to open or close the choke valve. The net force acting on the plug of the valve is a result of the flow pressure generated by the fluid flowing through the choke valve acting on the relative cross-sectional areas of the plug and the control piston. A difference in the areas results in the net force. In the preferred embodiment, this net force tends to automatically open the valve upon increased well bore pressure and to close the valve upon decreased pressure.

The hydraulic system for maintaining the control piston and choke at the desired position with respect to the wear sleeve for a selected well bore pressure includes a hydraulic cylinder and head associated with the control piston on which the plug is mounted. When pressure on the plug disturbs the equilibrium, the piston movement is translated into a pressure signal in the hydraulic control system which then automatically readjusts the piston position to reestablish the desired pressure or flow rate in the choke valve. Controls having gauges for indicating various well bore parameters to assist in the controlling of well bore pressure and pressure regulators for venting the system in the event well pressure exceeds a set-point pressure are also included.

OBJECTS OF INVENTION

It is therefore a primary objective of the present invention to automatically control the flow of fluid from a well bore by a novel choking device, or choke valve, which better regulates the fluid flow and varying fluid pressures encountered in well operations.

It is a more specific object of the present invention to provide a choke valve means which has a helical flow path therethrough in which the area of the flow path varies or tapers along its length.

It is another object of the present invention to provide increasingly sensitive control over well bore pressure and flow rate as that pressure or flow rate increases.

Still another object of the present invention is to provide a well choke valve which is less susceptible to error due to erosion than previously known choking valve mechanisms.

Another object of the present invention is that the components which are subject to wear and potential erosion are readily replaceable without requiring an entirely new valve mechanism.

A still further object of the present invention is to provide a choke valve which opens or closes in the desired manner in response automatically to fluctuations in inlet pressure or flow rate.

It is yet another object of the present invention to provide a well choke valve which is easily controlled by simple and inexpensive control systems and is easily accessible for cleaning.

It is yet a further object of the present invention to provide a control system for a well choke valve which automatically vents to protect against unduly high pressures.

A still further object of the present invention to provide a well choke valve which is automatically controlled according to the net force exerted on that valve by the fluid passing through that valve.

And it is yet another specific object of the present invention to provide a visual indication of choke valve position.

It is still a further object of the present invention to provide a method of automatically controlling the flow through a well choking valve means.

Further, it is an object of the present invention to provide a valve mechanism which can control the variations in well bore pressures in a simple, efficient and inexpensive manner.

These and other objects of the present invention, as well as many of the attendant advantages thereof, will become more readily apparent when reference is made to the following description taken in conjunction with the accompanying drawings.

BRIEF DESCRIPTION OF THE DRAWINGS OF THE PREFERRED EMBODIMENTS

FIGS. 6 and 7 show alternative embodiments of the valve shown in FIGS. 2 through 4;

FIG. 8 shows an apparatus used to indicate the position of the valve designed in accordance with the teachings of the present invention;

DETAILED DESCRIPTION OF THE PREFERRED EMBODIMENTS

Figure 1:
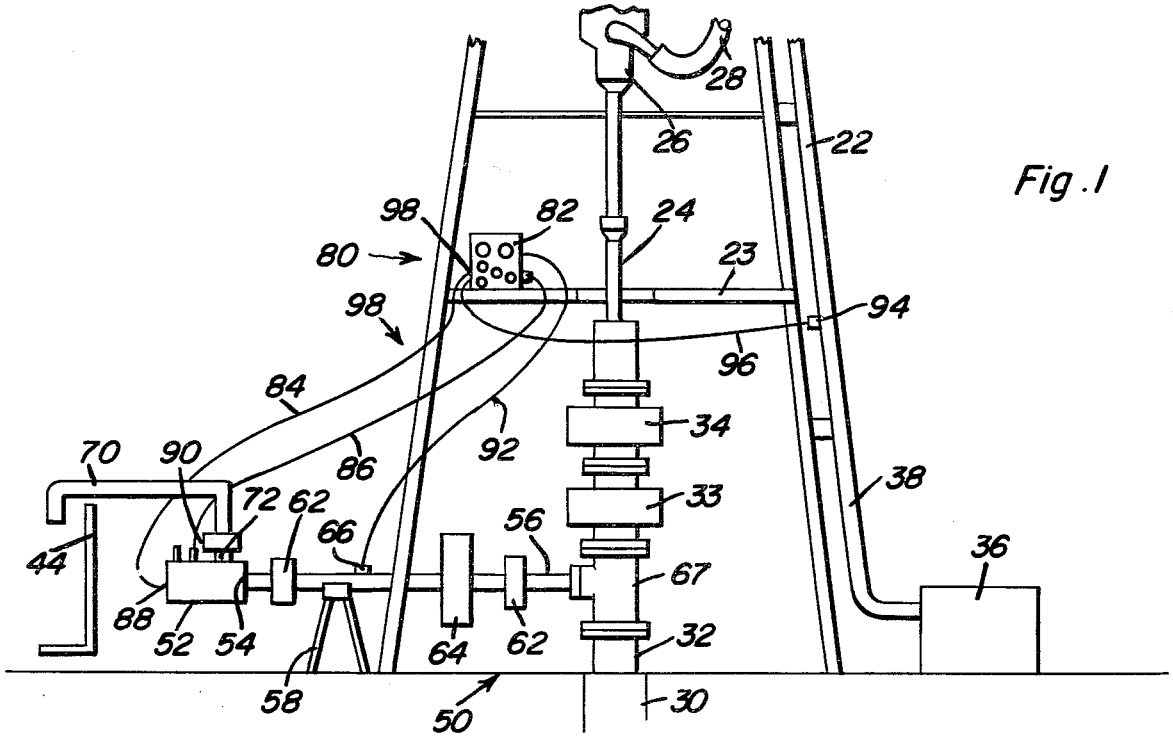
FIG. 1 is an elevational diagram of the well drilling equipment embodying the apparatus of the present invention.

Shown in FIG. 1 is a diagrammatic illustration of a drilling system 20 embodying the apparatus of the present invention. The drilling system comprises a derrick 22 having a rig floor 23 supporting rig hoisting equipment (not shown) attached to a drill stem 24 by a Kelly joint 26 which includes a Kelly hose 28. The drill stem is inserted into a well bore 30 having a well casing 32 which is provided with the usual blowout preventers 33 and 34. A pump 36 supplies drilling fluid, such as drilling mud, to the drilling system through line 38 and Kelly 26 also in the usual manner.

Drilling fluid is discharged from the drilling system into a discharge tank 44 by discharge system 50. The discharge system 50 comprises fluid control valve means 52 having an inlet 54 connected to choke line 56 which is supported by supporting means 58 and having control valves such as manual valves 62 and hydraulic valve 64, and pressure tap 66 thereon. The choke line is connected to well casing 32 by tee 67 located below blowout preventers 33 and 34 as is the usual practice. The fluid control valve 52 has discharge pipe 70 connected thereto at an outlet 72 for discharging drilling fluid into the tank 44. A fluid control system 80, having a control panel 82, is connected to fluid control valve means 52 by hydraulic lines 84 and 86 which are each attached to the valve by pressure ports 88 and 90, respectively, and is connected to choke line 56 by pressure sensing line 92 attached to line 56 at pressure tap 66. Fluid pressure in line 38 is monitored by control panel 82 through a tap 94 connecting one end of a conduit 96 to the pump line 38. The other end of conduit 96 is attached to control panel 82 by a suitable connection. The pressure in line 38 can therefore be sensed by a pressure sensing means in panel 82. Fluid, such as hydraulic oil, is used to actuate valve 52 and is supplied by a pump and reservoir system located in system 80 and will be discussed in greater detail subsequently. Therefore, a hydraulic control system 98 comprising lines 84 and 86 and the control system pump and supply are used to control the movement of valve 52.

Figures 2, 3, 4, 5:
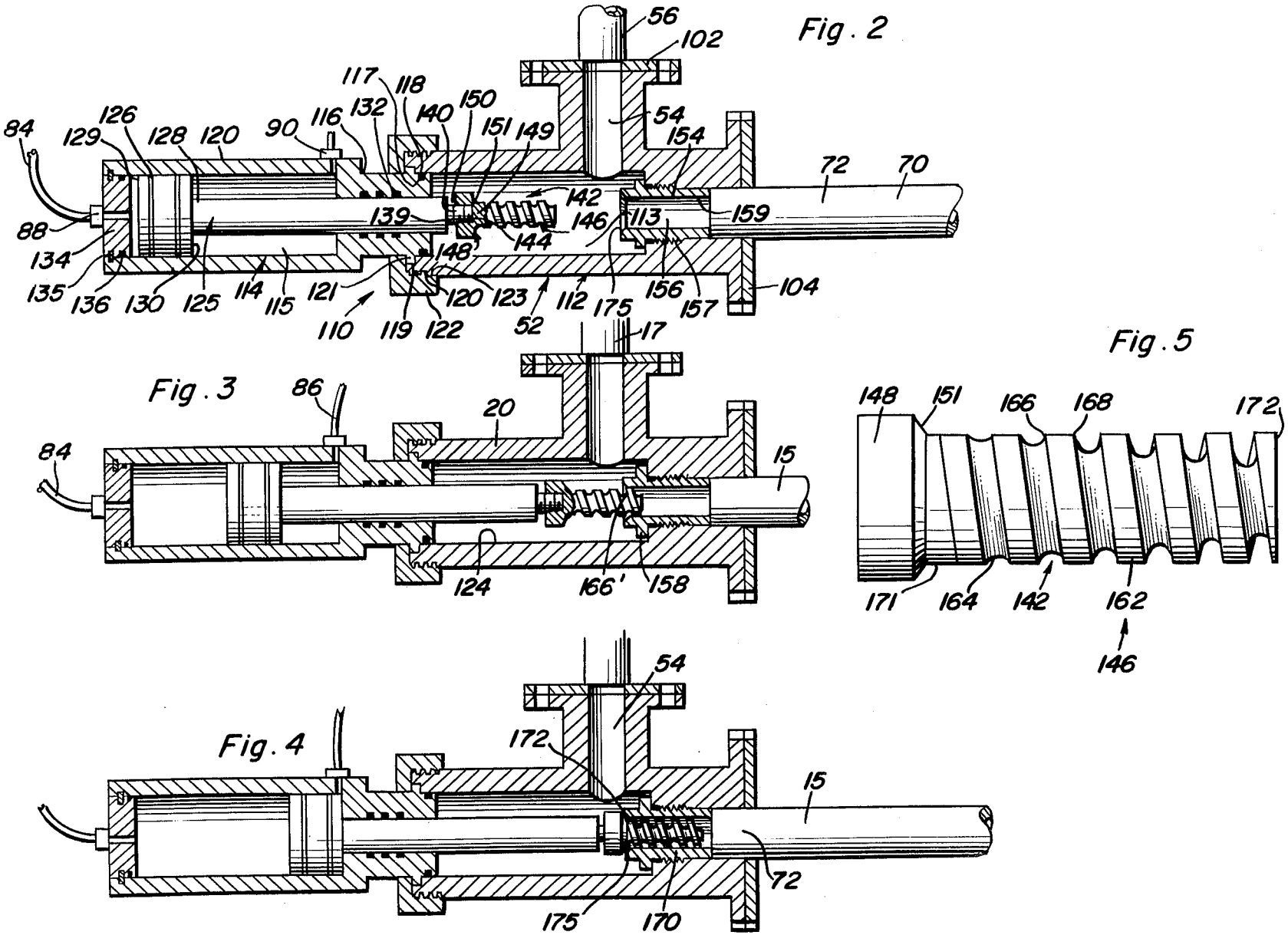
FIGS. 2 through 4 are horizontal cutaway views of the preferred valve in accordance with the teachings of the present invention.
FIG. 5 is an enlarged view of the preferred screw-like plug used in the form of valve shown in FIGS. 2–4.

From FIG. 1, it is seen that drilling fluid discharged from well casing 32 passes through choke line 56 and into discharge tank 44 after passing through fluid control valve means 52. The fluid control valve means is used to control the movement of the drilling fluid through the discharge system 50 and is best shown in FIGS. 2 through 4. It will also be noted that inlet 54 and outlet 72 of valve 52 are rotated from the position shown schematically in FIG. 1 which is intended to show the relative positioning of the choking mechanism in a well operation and not the exact positioning of the inlet and outlet parts of the valve.

Valve means 52 is shown in FIG. 2 in the fully open position wherein fluid communication between choke line 56 connected to the valve inlet 54 by flange means 102 and discharge pipe 70 connected to valve outlet 72 by flange means 104 is unrestricted. As shown, the valve means has an overall housing 110 which is divided into a tee section 112 having a chamber 113 housing the valve inlet and outlet. The housing 110 also comprises a second section 114 comprising a piston chamber 115 and a connecting neck 116 having a smaller outer diameter than the second section 114. The neck section forms one end of the piston chamber and closes off chamber 113 by seal seat 117 for seal 118 and radial flange 119 engaging a section of tee 112. The engaged section is opposite the outlet 72 of the tee and includes abutment shoulder 121 surrounding the section and presented outwardly thereof. An annular hammer ring 122 engages the section and is threadably attached thereto by cooperating threads 123 and engages neck 116 around the radial flange 119. Therefore, second section 114 is attached to tee 112 by positioning radial flange 119 against shoulder 121 and threadably engaging the hammer ring 122 to the tee section thereby trapping the flange 119 against the shoulder 121 and seal 118 against inner surface 124 of tee 112. By removing the hammer ring, the valve can easily be opened for servicing.

Housed in an axially slidable relation within piston chamber 114 is a piston 125 having a head 126 and a control shaft 128. Piston head 126 has a first face 129 presented toward port 88 and a second face 130 presented toward port 90. Piston control shaft 128 is preferably cylindrical, as is piston chamber 114 and enables the piston to be slidably engaged within the chamber. Seals on head 126 and on the internal surface of neck portion 116 provide proper piston sealing during piston movement. Piston movement is controlled by hydraulic fluid contained within the chamber and pumped into and out of the piston chamber via hydraulic lines 84 and 86 of the fluid control system 98. As shown in FIG. 2, port 88 is defined in an end cap 134 mounted in the end of piston chamber 114 which is opposite to that end defined by the neck portion. Splines and seals provide proper mounting of the end cap in the piston chamber.

Mounted on the end of piston shaft 128 on the end opposite to head 126 is a threaded lug 140 for attaching a plug 142 thereto as by threaded connection 144. The plug 142 has a bolt-like configuration and comprises an external helix on a body portion 146 and a head portion 148 having defined therein a female threaded bore which engages threads of lug 140 to form the aforementioned threaded connection 144. Plug 142 is directed toward valve oulet 72 which has positioned therein a generally cylindrical wear sleeve insert 154 having a bore 156 therethrough. The outer periphery of insert 154 has external threads to matingly engage internal threads on outlet 72 to form a threaded connection 157. A flange 158 and a seal ensure proper seating of insert 154 within outlet 72 which has a slightly larger diameter than the insert 154 to facilitate ready removal and replacement of the insert. The bore 156 is shaped to receive plug body 146 which is axially aligned therewith and moves into the insert to control and/or interrupt the fluid connection between the outlet and inlet of the valve 52. The inner surface 159 of sleeve 154 has an inside diameter which allows the sleeve to mate with the major dimension of the threads on body portion 146.

FIGS. 3 and 4, respectively, show two positions of plug 142 with respect to insert 154. As shown in FIG. 4, the length of insert 154 is essentially equal to the length of plug threaded body 146. When the body 146 is entirely received within insert 154 and the valve thereby essentially closed, piston head face 130 is immediately adjacent port 90, whereas in the fully-open position shown in FIG. 2, piston head face 129 is immediately adjacent port 88.

As shown in FIG. 5, the outer diameter of plug head portion 148 is larger than the maximum major diameter of the external screw-like threads on plug body 146 and tapers into a shoulder section 151 shaped to matingly abut corresponding shoulder 175 on insert 154 when the valve is in a fully closed position, as shown in FIG. 4. The screw-like thread on plug body 146 has outwardly presented faces 162 presented in the axial direction. As shown in FIGS. 3 and 4, when the plug 142 is received in bore 156, insert 154 and plug body 146 form a helical or spiral duct 170. The helical duct 170 fluidly connects inlet 54 and outlet 72 of the valve means. As best shown in FIG. 5, the minor diameter of the screw-like body tapers along the thread length from the head portion end 171 toward the outer end 172. The tapered configuration of the minor diameter of the plug 142 is also shown in FIG. 6. By tapering the plug body to decrease the minor diameter along that body, the flow area of spiral duct 170 correspondingly increases along the length of plug body 146. Thus, the flow area of duct 170 proportionally decreases as the plug is further inserted within wear sleeve insert 154.

By moving plug 142 in or out with respect to insert 154, not only is the effective length of the spiral duct varied to secure a proportionate variation in flow resistance but, more importantly, the flow area or opening of the valve is altered. By adjusting the flow area and effective length of the duct, the flow of the drilling fluid through the duct is controlled and the overall pressure drop of such fluid through the well bore is adjusted, thus controlling the well bore pressure. Accordingly, the pressure drop of the drilling fluid varies in relation to the distance with which plug 142 is engaged into insert 154, which engagement, in turn, can be adjusted by the position of piston 125. The piston 125 moves in response to the hydraulic pressure applied to faces 129 and 130 by fluid provided and controlled through control system 80.

As shown in FIGS. 2 through 4, the fluid pressure on piston 125 by drilling fluid passing through chamber 113 of tee 112 exerts a leftwardly directed force because the cross-sectional area of face 139 of the control shaft 128 and shoulder 151 exceeds that of the plug body portion 146. This net force is opposed by the net rightwardly directed force from the hydraulic pressure applied to piston head 126. The net rightwardly directed force on the piston head results from the difference in force applied to face 129 by fluid from line 84 which force exceeds that force resulting from the pressure applied to face 130 by fluid from line 86.

Thus, when the piston 125 is in the partially closed position shown in FIG. 3, the force resulting from the fluid pressure exerted on face 139 and shoulder 151 is balanced by the net rightwardly directed force exerted on piston head 126. If a higher well bore pressure condition suddenly occurs in choke line 56 (for example a kick) thus upsetting the pressure equilibrium or the control piston, a net leftwardly directed force is exerted on the plug because of the greater surface area of face 139 and shoulder 151. As the net leftwardly directed force increases and overcomes the rightwardly directed force exerted on the control piston, the piston is forced to the left (i.e., toward a further open position), thereby automatically opening the valve to a greater flow area for the drilling fluid. By so opening, the valve tends to automatically relieve the increased pressure until the control system is able to move piston 125 and plug 142 to a position where equilibrium is again restored.

If well bore pressure decreases the reverse of the above-described procedure occurs. The plug is initially moved to the right whereupon the flow area defined by the helical flow path is automatically reduced. Such reduced flow area automatically reduces the rate of flow and tends to increase the bore pressure until the control system 80 senses and equalizes the situation. Thus, it is seen that the initial reaction of the choking valve means is to automatically respond to a change in well bore pressure in a manner which tends to correct the altered condition.

In the preferred embodiment, the piston shaft 128 has an outer diameter at least equal to or greater than the outer diameter of plug head 148 as shown in FIGS. 2–4.

An alternative embodiment of valve 52 is shown in FIG. 6 and is identified by numeral 52'.

Valve means 52' comprises tee 112' having an undercut region in chamber 113' adjacent outlet 72'. Outlet 72' has a counterbore into which is engaged wear sleeve insert 154' and seals. Insert 154' has on one end an abutment face 174 for engaging the shoulder of the counterbore and on the other end a tapered shoulder 175' for engaging shoulder 151' of plug head 148' when the plug is fully inserted into the insert as shown in FIG. 6.

Threadably engaged with tee 112' is a second section 114' having on one end cap 134 and on the other end a tail 176 having external threads for threadably engaging cooperating internal threads on the tee opening opposite to outlet 72'. Seals mounted on tail 176 ensure a leakproof chamber 113'. Tail 176 is threaded into tee 112' until cooperating abutment shoulders 177 on the piston chamber and 178 on the tee engage to ensure a secure connection between the piston chamber and the tee.

Mounted within valve 52' and axially aligned with outlet 72 is a piston 125' comprising a piston shaft 128' having on one end external threads for engaging cooperating threads on the internal surface of a bore in plug head 148'. The piston shaft further comprises on the other end a piston head 126' having oppositely presented faces 129' and 130' and slidingly received in a piston chamber 115' of second section 114'. The hydraulic control system 80 is connected with chamber 115' in a manner similar to that used in the preferred embodiment of valve means 52.

As shown in FIG. 6, control piston shaft 128' is cylindrical and has a diameter less than the diameter of plug head 148' and the operation of valve 52' differs slightly from that of valve 52. In the form of FIG. 6, the fluid pressure in chamber 113' exerts a rightwardly directed force to the control shaft 128'. When in equilibrium, the force on plug face 150' is opposed by the net force on piston head 126', resulting from the hydraulic pressure applied to faces 129' and 130' by the control system 80 through lines 84 and 86, respectively.

A further embodiment of the valve means 52 is shown in FIG. 7 and denoted by the reference numeral 52''. Valve 52'' has internal grooves 179 formed in surface 157'' of wear insert 154'' to cooperate with a solid plug 142'' to form helical or spiral duct 170''. Groove 179 forms a spiral path in the surface 157'' the depth of which varies or tapers along its length from the inlet end of the insert adjacent the plug 142'' where the grooves 179 are the deepest to the exit end where the groove 179 becomes flush with the inner surface 157''. Thus, the flow area of duct 170'' varies according to the degree to which plug 142'' is inserted within wear sleeve 152''. The valve 52'' is shown in the fully open position in FIG. 7, and as seen, when plug 142'' initially engages insert 152'', the flow area of duct 170'' has a value which is large relative to that flow area which is produced by continued insertion of plug 142'' into the sleeve.

Locating the control panel 82 of control system 80 on the rig floor 23 permits monitoring of the pressures that are being controlled. Thus, if a kick occurs, the pressures registered on panel 82 can be readily observed by the rig operators in order to control the kick as well as obtain data on that kick. Shown in FIG. 8 is a valve position indicator system 200 which may be used for indicating the position of control piston 125 and therefore plug 142 in the choke valve means. System 200 can be used in conjunction with the control system 98 to monitor well bore pressures. System 200 comprises a pressure gauge 202 for visually indicating the position of piston 125 and has a gauge face 204 graduated according to percentage of opening or closing of the valve. An indicator 206 shows this data. By using the readings obtained from pressure gauge 202 in conjunction with the readings from control system 80, a record of well bore pressure can be obtained.

A suitable branch connection 208 attaches gauge 202 to a conduit 210 filled with a hydraulic fluid, such as oil. Also attached to conduit 210 by a suitable branch connection 212 is a cylindrical accumulator 218 having a bore 214 and a cylindrical housing 211. Pressure gauge 202 senses the pressure in conduit 210 which pressure is controlled by the accumulator 218. The pressure in conduit 210 is translated into piston position by a suitable conversion factor in accordance with flow areas within the system and the type of fluid used. A piston 220 having thereon a seal 221 sealingly engaging inner surface 223 of bore 214 is received within bore 214 and is longitudinally slidable therein. Piston 220 has a face 224 presented inwardly of bore 214 and a face 225 presented outwardly thereof. The bore volume between piston 225 and branch connection 212 defines an accumulator chamber 226 which volume is controlled by the movement of piston 220 within bore 214. Cylindrical housing 211 has one end 227 internal threads 228 presented inwardly of bore 214 for threadably engaging external threads 230 of an adjusting bolt 232. Adjusting bolt 232 has on one end a sealing head 234 having a face 236 presented inwardly of bore 214 toward connection 212 to sealingly close that bore, and on the other end an adjusting knob 237. A compression spring 238 is located within bore 214 and seats on a first spring seat 240 defined in face 224 of piston 220 and on a second spring seat 242 defined in face 236 of adjusting bolt 232. Spring 238 biases piston 220 toward connection 212.

Conduit 210 is connected on one end to a check valve 250 and on the other end to an axial bore 252 defined in piston head 126 and piston shaft 128. Check valve 250 prevents fluid from leaving conduit 210 but allows fluid to enter that conduit from supply line 254 attached to a reservoir 256.

Conduit 210 enters the second section 116 of the valve means through end cap 134 and is received in bore 252 of piston 125 and sealed therein by a seal 269. Conduit 210 has an open end 274 and thus, the conduit 210 and the bore 252 are in fluid communication and fluid contained in conduit 210 is allowed to flow into and out of bore 252 through end 274 of the conduit 210. A threaded union means 280 on housing conduit 260 threadably engages a union seat 282 on end cap 134 for securely holding conduit 210 and 260 in the proper orientation with respect to bore 252.

As shown in FIG. 8, conduit 210 establishes fluid communication among bore 252, accumulator chamber 226 (via connection 212) and gauge 202 (via connection 208). By adjusting the bias of spring 238, the fluid pressure within conduit 210 is adjusted and by suitably calibrating gauge face 204, the fluid pressure within conduit 210 as sensed by pressure gauge 202 is translated into an indication of the position of piston 125 and thus plug 142 within the wear insert 154.

In operation, system 200 indicates the position of piston 125. Thus, for example, an opening movement of the piston (i.e., leftward movement of the piston and plug in the Figures) is sensed by system 200 and indicated on gauge 202. Proper calibration of gauge face 204 will yield the desired results. The gauge can be calibrated to indicate a fully open position of the piston and the fully closed position of the pistons as well as all positions therebetween.

Figure 9:
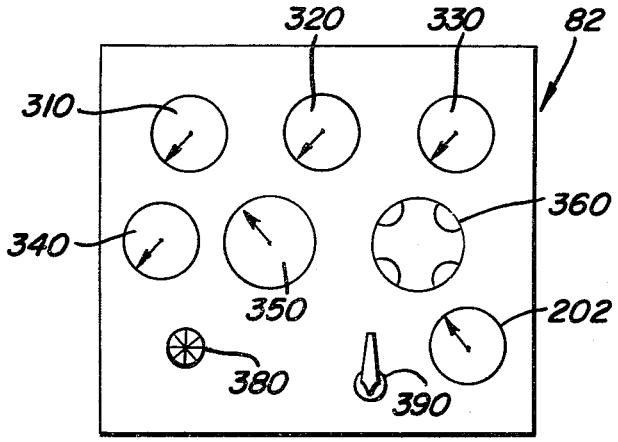
FIG. 9 shows a control panel used to control the valve of the present invention.
Figure 10:
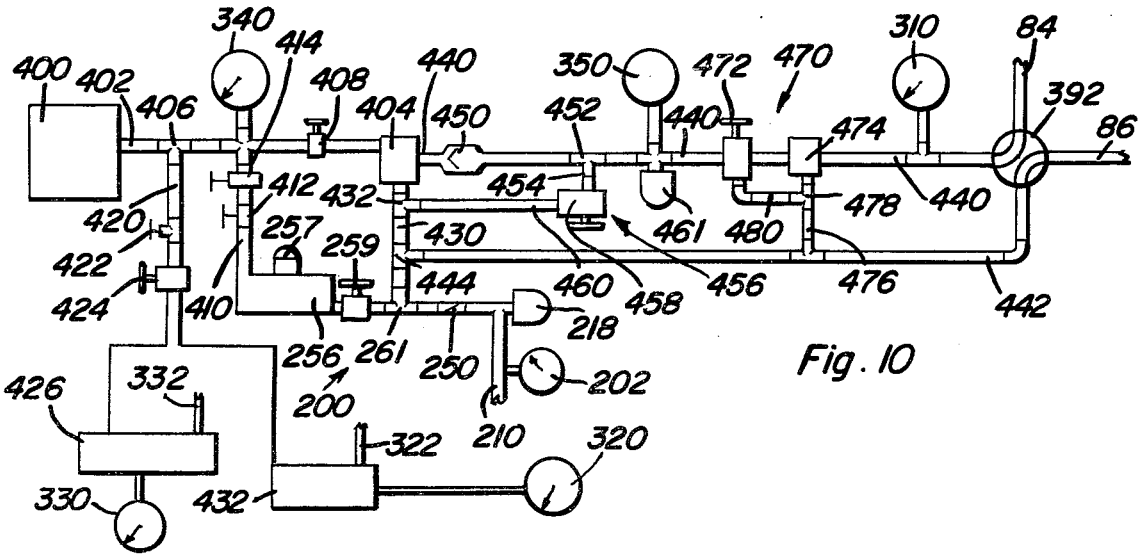
FIG. 10 shows a fluid control circuit used to control the valve of the present invention.

Shown in FIG. 9 is the control panel 82 used to control the hydraulic system 80. As shown in FIGS. 9 and 10, the control panel comprises: a maximum choke pressure gauge 310 to indicate the maximum pressure at which the choking valve means 52 is set to maintain; a choke manifold pressure gauge 320 for indicating pressure in choke manifold 322; a stand pipe pressure gauge 330 for indicating pressure in standpipe 332; an air supply pressure gauge 340; a hydraulic pump pressure gauge 350 for indicating the pump pressure of pump 36; a hydraulic regulator 360 for venting the hydraulic fluid supply system 98; position indicator 202; an air regulator 380 for settling the air pressure to pump 36 to determine the maximum hydraulic pressures which can be delivered by that pump; and a control handle 390 which is attached to a four way valve 392. The four way valve 392 is used to direct the fluid flow in fluid supply system 98 selectively to lines 82 or 84 to close or open valve 52, respectively.

The operation of the discharge system control panel 82 can be best understood by referring to FIG. 10. Fluid, such as air, is supplied for the hydraulic control system 98 from supply means 400 through supply line 402 to hydraulic pump 404 of the hydraulic control system 98. Supply line 402 comprises a tee connection 406 and has air supply pressure gauge 340 and an air pressure regulator 408 mounted thereon. Also, connected to air supply line 402 through conduit 410, a control valve 412 and regulator 414, is reservoir 256 of the valve position indicator system 200. Reservoir 200 is equipped with relief vent 257. The indicator system 200 is more fully described above in conjunction with FIG. 8 and attention is directed to that discussion. As shown in FIG. 10, a manual cut-off valve 259 and a tee connection 261 are positioned in the system 200 to control the flow of fluid in conduit 210.

Also connected to supply line 402 by the tee connection 406 is line 420 having a manual valve 442 and a regulator 424 thereon and fluidly connecting supply line 402 to a pressure transmitter 426 for monitoring the pressure of the pressure of the choke manifold 322. The aforementioned panel gauge 330 and 320 are connected to pressure transmittors 426 and 432, respectively, for indicating on panel 82 the standpipe and choke manifold pressures.

Air pressure supplies pressure to the oil system which in turn maintains pressure in the position indicator system 200 through a line 430 attached to system 200 by tee 261. Pump 404 delivers fluid under pressure into line 440 and to four way valve 392 which then selectively directs the fluid into line 84 or line 86 to the opening side of piston 126 or to the closing, or operation side of piston 126 of the valve means 52 into a return line 442. A suction line from tank 256 has a tee 261 which permits fluid to enter through check valve 250 into the system 200.

Connected to line 440 is a check valve 450 and a tee 452 connecting line 440 to a pipe 454 of a regulator system 456. Regulator system 456 comprises pressure regulator 458 and a pipe 460 connected to tee 432 of line 430. Regulator system 456 is a safety device for limiting the maximum pressure on the components of the control panel 82. Also attached to line 440 is pump pressure gauge 350 for indicating the pressure in line 440 and an accumulator 461.

Pressure relief system 470 is also connected to line 440 and comprises a self-venting hydraulic regulator 472 attached to line 440 for venting that line in the event pressure past the regulator exceeds a set-point pressure. A quick releasing sensor 474 is connected to line 440 ahead of the regulator 472 and is connected to return line 442 by a pipe 476 having a tee 478 therein to which is connected a pipe 480 providing fluid communication between regulator 472 and quick releasing sensor 474. Quick releasing sensor 474 senses a balanced pressure across the sensor and which relieves and vents the system in the event pressure from the discharge side increases, in which case a valve snaps open to vent the excess pressure back to the fluid reservoir 256. Pressure gauge 310 is also connected to line 440.

Obviously, numerous modifications and variations of the present invention will occur to those skilled in the art in light of the preferred and alternate embodiments disclosed herein above without departing from my invention. For example, certain advantages, albeit not the full advantages, can be achieved by a helical flow path defined by threaded plug or insert in which the threads are not tapered. Furthermore, the variable dimensioned helical flow path can be achieved by varying the thread depths on either or both the plug and the insert or in a manner different than a straighline taper. In addition, it is possible to achieve the advantages of this invention not only by having mating threads in the plug and insert which produce a helical flow path of varying cross-sectional area but also by having opposite threads in the plug and the insert, such as, right hand thread on the plug and left hand thread on the insert. Such opposite threads would thus form a pair of helical flow paths which cross-over or interconnect where the opposite threads intersect. It is therefore understood that intended that my invention not be limited to the precise forms described, but to encompass all embodiments falling within the scope of the appended claims.

I claim:

1. A choke valve for controlling the flow of fluid which comprises means defining a valve chamber having an inlet and an outlet, said outlet defined by an axial bore, a movable bolt-like plug means axially aligned and received within said axial outlet bore to establish at least one helical flow path through said outlet, the relative position of said plug means within said outlet bore controlling the flow of said fluid through said outlet and movement of said plug means within said outlet bore controlled by a hydraulically operated piston means, and surface means associated with said plug means and said piston means which is instantaneously responsive to a change in pressure in said valve chamber to move said plug means within said outlet bore in a direction to dissipate said pressure change.

2. A valve for controlling and varying the quantity of a liquid flowing therethrough which comprises (a) a valve housing having an inlet and an outlet, said outlet defining an axial bore and (b) a bolt-like plug means axially aligned with and movable within said bore, said bore and said plug means cooperating to form a helical flow path through said outlet, which flow path has a decreasing flow area as said plug means is further inserted within said bore.

3. The valve according to claim 2 wherein a control piston is attached to said plug means and a surface means is associated with said plug means and said control piston which is instantaneously responsive to a change in pressure at said inlet to automatically move said plug means in a direction within said bore to automatically change the flow area of said outlet and tend to dissipate said change in pressure.

4. A choke valve according to claim 1 wherein said helical flow path has a flow area which progressively decreases with further insertion of said plug means within said axial outlet bore.

5. A control valve according to claim 1 wherein said outlet defined by an axial outlet bore comprises an outlet opening having a replaceable wear sleeve with an axial bore therethrough threadedly positioned within said outlet opening for periodic replacement during the life of the choke valve.

6. A choke valve according to claim 1 wherein said surface means engages a cooperating surface adjacent said axial outlet bore when said plug means is fully inserted within said bore to completely close the valve.

7. A choke valve according to claim 1 wherein said valve chamber is defined by a housing means having a male threaded junction and a closure means having a female threaded junction which are in threaded engagement together, said piston means reciprocating through said closure means whereby said movable plug means and said piston means can be removed from and access secured to said valve chamber by disengaging said closure means from said housing.

8. The valve according to claim 1 wherein said choke valve controls the drilling fluid in a choking system of the type used in a well drilling operation.

9. Choke valve means for controlling the flow of a fluid which comprises a valve housing having an inlet and an outlet defined therein, and a movable solid bolt-like plug means cooperating with said outlet to selectively engage and disengage with said outlet and having threads thereon to define with said outlet a helical dust when said plug is engaged in said outlet through which said fluid passes, and an abutment head on said plug means to engage with said outlet to completely close the valve when said plug means is fully inserted within said outlet.

10. The choke means defined in claim 9, wherein said valve also includes a piston means having a housing connected to said valve housing defining therein a piston chamber containing hydraulic fluid of the type used in hydraulic systems, a piston head slidably received in said piston chamber, a piston shaft extending into said valve housing, said control means for controlling the movement of said piston in said piston chamber.

11. The choke means of claim 10 wherein said piston shaft is essentially cylindrical and has an outer diameter greater than the outer diameter of said bolt-like plug means.

12. The choke means of claim 10, wherein said piston chamber comprises first and second port means positioned on opposite sides of said piston for conducting said hydraulic fluid into and out of said piston chamber.

13. The choke means of claim 9, wherein said outlet is in the form of a cylindrical bore, the major diameter of the plug means is essentially uniform over the length of said bolt-like plug means, and said threads on said plug means have a minor diameter which tapers away from the entrance to said outlet bore, whereby said helical duct has a progressively increasing flow area along the length of said plug means which increases toward the end inserted first into said cylindrical bore.

14. The choke means of claim 9 and including a choke line of the type used in well drilling operations in which said choke valve means is assembled.

15. Choke means for controlling the flow in a well choking system comprising:

a choke line of the type used in well drilling operations;

a choke valve means in said choke line adapted to pass fluid from a well bore therethrough, comprising a valve housing having an inlet and an outlet defined therein, each cooperating with said choke line, a movable bolt-like plug means cooperating with said outlet to selectively engage and disengage with said outlet, a spiral groove defined in the surface of said outlet in said housing and cooperating with said movable plug means to define a spiral duct in said outlet when said plug means is engaged in said outlet through which said fluid passes, a piston means controlling the movement of said movable plug, and a surface means associated with said plug means and said piston means which is instantaneously responsive to a change in pressure at said valve inlet to move said plug means within said outlet in a direction to dissipate said pressure change.

16. Choke means for controlling the flow in a well choking system including:

a choke line of the type used in well drilling operations; and a choke valve means in said choke line adapted to pass fluid from a well bore therethrough, comprising a valve housing, having an inlet and an outlet defined therein, each cooperating with said choke line, a movable solid bolt-like plug means cooperating with said outlet to selectively engage and disengage with said outlet, said plug means having thread means thereon to define with said outlet a spiral duct when said plug means is received in said outlet through which said fluid passes, and a piston means controlling the movement of said movable plug means, said piston means comprising an essentially cylindrical piston shaft and said plug means having a generally cylindrical bolt-like plug head section whose diameter is smaller than the diameter of said piston shaft.

17. Choke means according to claim 16 wherein said outlet is defined by a generally cylindrical bore and the depth of said thread means tapers along the length of said plug means in a direction away from said outlet so that the flow area of said spiral duct decreases as said plug means is further received in said generally cylindrical bore.

18. Choke means according to claim 16 wherein said outlet comprises an outlet opening having a replaceable wear sleeve with an axial bore therethrough threadedly positioned within said outlet opening for periodic replacement during the life of said choke valve means.

19. Choke means according to claim 16 and including a surface means associated with said movable plug means which cooperates with a corresponding surface means adjacent said outlet so as to completely close the choke valve means when said plug means is fully received within said outlet.

20. In combination with a choke means for a well choking system having a choke valve comprising a movable plug means for controlling well bore pressure and a piston for controlling the movement of said movable plug means, an indicating system containing hydraulic fluid, said system indicating the position of said movable plug means and comprising an accumulator means, a pressure gauge means, a fluid pressure generating means responsive to the relative position of said movable plug means, and fluid connecting means establishing fluid communication between said gauge means, said accumulator means and said fluid pressure generating means whereby movement of said plug means automatically alters the pressure within said gauge means.

21. The combination defined in claim 20, wherein said fluid connecting means slidably engages a bore defined in said piston in such a manner that said bore is in fluid communication with said accumulator means and said gauge means so that movement of said piston effects a pressure change within said indicating means system in accordance with the position of said piston.

22. In combination with a choke means comprising a valve means having a movable plug to control well bore pressure, a piston means controlling the movement of said plug means, and an indicating means for indicating the position of said movable plug means, a hydraulic system controlling the movement of said movable plug means comprising: a four way valve means; a relief valve means; a booster pump means; an accumulator means; first fluid connecting means establishing fluid communication between said four way valve means, said relief valve means, said booster pump means and said accumulator means; second fluid connecting means establishing fluid communication between said four way valve and said piston means; and a third fluid communicating means establishing fluid communication between said hydraulic system and said indicating means.

23. A method of controlling well bore pressure comprising the steps of:

providing a chamber having an inlet and an outlet in the flow path of fluid exiting a well bore;

causing said fluid to flow through an elongated duct in said outlet to control the flow conditions therethrough and the fluid pressure in the chamber and instantaneously changing the length of said elongated duct in response to changes in the pressure in said chamber in a manner to dissipate said pressure changes and thereby control the pressure in said well bore.

24. The method of claim 23, further including the step of indicating the length of said spiral duct by fluidly connecting a calibrated gauge thereto.

25. The method of claim 24, further including the step of controlling the length of said spiral path by a hydraulic system.

26. The method of claim 23, wherein changing the length of said spiral duct also changes the flow area of said duct.

27. Choke means for controlling the flow in a well choking system including a choke line of the type used in well drilling operations and a choke valve means in said choke line adapted to pass fluid from a well bore therethrough, comprising means defining a valve chamber having an inlet and an outlet, said outlet defined by an axial bore, and a movable rod means having at least two generally cylindrical, axially aligned sections, one section having a smaller diameter and the other section having a larger diameter to define an annular surface therebetween, the smaller diameter section received within said outlet bore to define a flow path through said outlet determined by the relative position of said smaller diameter section in said outlet bore and said annular surface being responsive to a change in pressure in said valve chamber to automatically move said rod means within said outlet bore in a direction to dissipate said pressure change.

* * * * *